US005537895A

United States Patent [19]

Young et al.

[11] Patent Number: 5,537,895

[45] Date of Patent: Jul. 23, 1996

[54] AUTOMATIC STEEL CUTTING RULE BENDER

[75] Inventors: William L. Young; David E. Young, both of Medina, Ohio

[73] Assignee: Ameri-Die, Inc., Medina, Ohio

[21] Appl. No.: 336,925

[22] Filed: Nov. 10, 1994

[51] Int. Cl.[6] ..... B21K 5/20; B21D 5/00

[52] U.S. Cl. ..... 76/107.8; 72/166

[58] Field of Search ..... 76/107.8, 107.1; 72/166, 168, 169; 140/102; 225/104, 105, 97, 1; 29/33

[56] References Cited

U.S. PATENT DOCUMENTS

| | | | |
|---|---|---|---|
| 3,734,146 | 5/1973 | Nazyrov et al. | 140/102 |
| 3,863,550 | 2/1975 | Sarka et al. | 93/58.3 |
| 4,773,284 | 9/1988 | Archer et al. | 76/107.8 |
| 5,111,675 | 5/1992 | Murata | 72/166 |
| 5,333,519 | 8/1994 | Holliday et al. | 76/107.8 |

OTHER PUBLICATIONS

Notting Nova Bender, undated.
Elcede, Ken Specialties, Inc., Bensenville, IL, undated.
Automatic Bending System BBS-1001, Tsukatani Hamono Mfg., Co., Ltd., Yao-City Osaka, Japan, undated.
CNC 2000 RPS Steel Rule Processing System, CNC, Lowell, MA, undated.

*Primary Examiner*—Douglas D. Watts
*Attorney, Agent, or Firm*—Reese Taylor

[57] ABSTRACT

Rule die stock for assembly in the kerf of a laser cut board is formed by utilizing the same program used to guide the laser cutter in forming the kerf to control the bending apparatus. A controller is provided with the same program and controls the feed of the stock into the bending tooling which is carried on operating arms, one of which is reciprocal with respect to the other and which is driven by an air head, the operation of which is controlled in response to programmed commands from the controller. In this fashion, correspondence between the configuration of the kerf in the board and the configuration of the rule die is assured.

15 Claims, 4 Drawing Sheets

AUTOMATIC STEEL CUTTING RULE BENDER

BACKGROUND OF THE INVENTION

This invention relates to the art of bending steel rule die stock to fit the kerf of a die board and relates in particular to an automatic rule bender designed to bend a male steel cutting rule to fit the curve of a laser cut die board using the same computer program that controls the laser cutter for the die board so as to insure precise registry between the two.

DESCRIPTION OF THE PRIOR ART

It is well known that in many industries stock is cut and scored by the utilization of die sets which comprise complemental male and female members. The male members include planar boards of various compositions slots configured to the shape of the article to be cut or scored and steel cutting knives and scoring rules embedded therein and projecting therefrom. The female members have a kerf or slot cut in their surface also conforming to the configuration of the finished part to be cut by the die set.

Extreme accuracy is necessary in constructing these die sets to avoid inferior cutting and scoring of the finished product. The kerfs or slots formed in the male and female members must be accurately formed to avoid misalignment and it is also necessary to bend the steel rule to the precise desired configuration in order to have it fit into the kerf of the male member.

Currently, the actual cutting of the kerf can be accomplished automatically by using a computer program to control a cutting apparatus so that the kerf is cut into the boards very precisely and that repetitive cuts are uniform and consistent. Sarka U.S. Pat. No. 3,863,550 shows a method of laser cutting for improved accuracy and computer controlled milling has also been employed. Holliday U.S. Pat. No. 5,333,519 also shows a method of increasing the accuracy of die placement. Obviously, it is desirable to achieve the same accuracy and precision with respect to forming the steel rule which ultimately must conform to the configuration of the kerf.

In the prior art it has been known to utilize steel rule benders which essentially comprise reciprocating members which move back and forth in a horizontal plane to selectively grasp and actually bend the die material between tooling carried by the bender as that material is fed into position between the reciprocating members. This manual operation is satisfactory but, obviously, has disadvantages, primarily in terms of speed of setup, accuracy of operation and economy. An example of such a bender is the Nova Bender available from W. Notting, Ltd., 17 Bowling Green Lane, London E.C. 1ROBH, England.

It has been known to utilize automatic bending systems which are controlled by a PC based system controller which will control the actual operation of the bending tooling. An example of this automation can be seen in the CNC RBS-2000 series automatic steel rule bending system available from CNC, 2235 Dewey Ave., Benton Harbor, Mich. This particular system is a fully automatic bending, notching and precision cutoff machine under the control of a computer and machine vision monitoring and operated by precision servo/stepper motor drives. Similar systems are available in the BBS-101 die making support system available from Tsukatani Hamono Mfg. Co., Ltd., 3-39 Kusune-cho, Yao-city, Osaka, Japan, and the Elcede machine available from Ken Specialties, Inc., 205 Park Avenue, Bensenville, Ill. 60106.

It has been found, however, that it is desirable to synchronize the feed of the material into the bender, the setup of the bender itself and the operation of the bender in accordance with a preprogrammed system which employs the same signals and controls as the program which drives the laser cutter for the boards. In this fashion, it is believed that it can be ensured that the resulting die will conform exactly, or nearly exactly, to the kerf previously cut in the die boards by the laser cutter controlled by the same program.

SUMMARY OF THE INVENTION

It is accordingly a principal object of this invention to provide a means for assuring that the rule die formed by the automatic steel cutting rule bender to conform precisely to the kerf cut into the board which receives the rule die.

In furtherance of this object it has been found that if a controller is provided for the automatic rule bender and is programmed with essentially the same program utilized to operate the laser cutter to cut the kerf and the board that precise correspondence between the configuration of the kerf and the board and the configuration of the rule die can be assured.

It has also been found, in accordance with the principal object of the invention, that drive means for feeding the stock to the bender can be likewise controlled by the controller and that positive and accurate feed can be achieved by providing an adjustable drive means comprised of opposed rolls which are adjustable both as to spacing between the rules and as to their orientation with respect to each other so that different widths of stock can be accommodated and the walls, or at least one of them, can be angled toward the other so as to prevent the stock from working its way out of the bite between the rolls.

Also in furtherance of the object of the invention, it has been found that the actual bending tooling can be carried on the end of opposed operating arms, one of which reciprocates with respect to the other during operation and is driven by an air head which in turn is also controlled by the controller, and by the program of the controller, so that the precise number of strokes can be achieved which are required to impart the proper configuration to the stock.

In furtherance of the objection of the invention, it has also been found that the remaining of the operating arms can be controlled by the controller for initial set up purposes and adjusted to its proper spacing relative to the principal reciprocating operating arm.

Also in furtherance of the principal object of the invention, it has been found that the actual bending tooling can be carried on a fixture disposed at the adjacent ends of the operating arms and can be operated again in response to commands from the controller to be elevated or retracted to facilitate both changing of the tooling and to enable the tooling to perform a cut off or severing function.

Accordingly, production of an improved automatic steel cutting rule bender of the character above-described becomes the principal object of this invention, with other objects thereof becoming more apparent upon a reading of the following brief specification and claims considered and interpreted in view of the accompanying drawings:

BRIEF DESCRIPTION OF THE PREFERRED EMBODIMENTS

Figure 1:
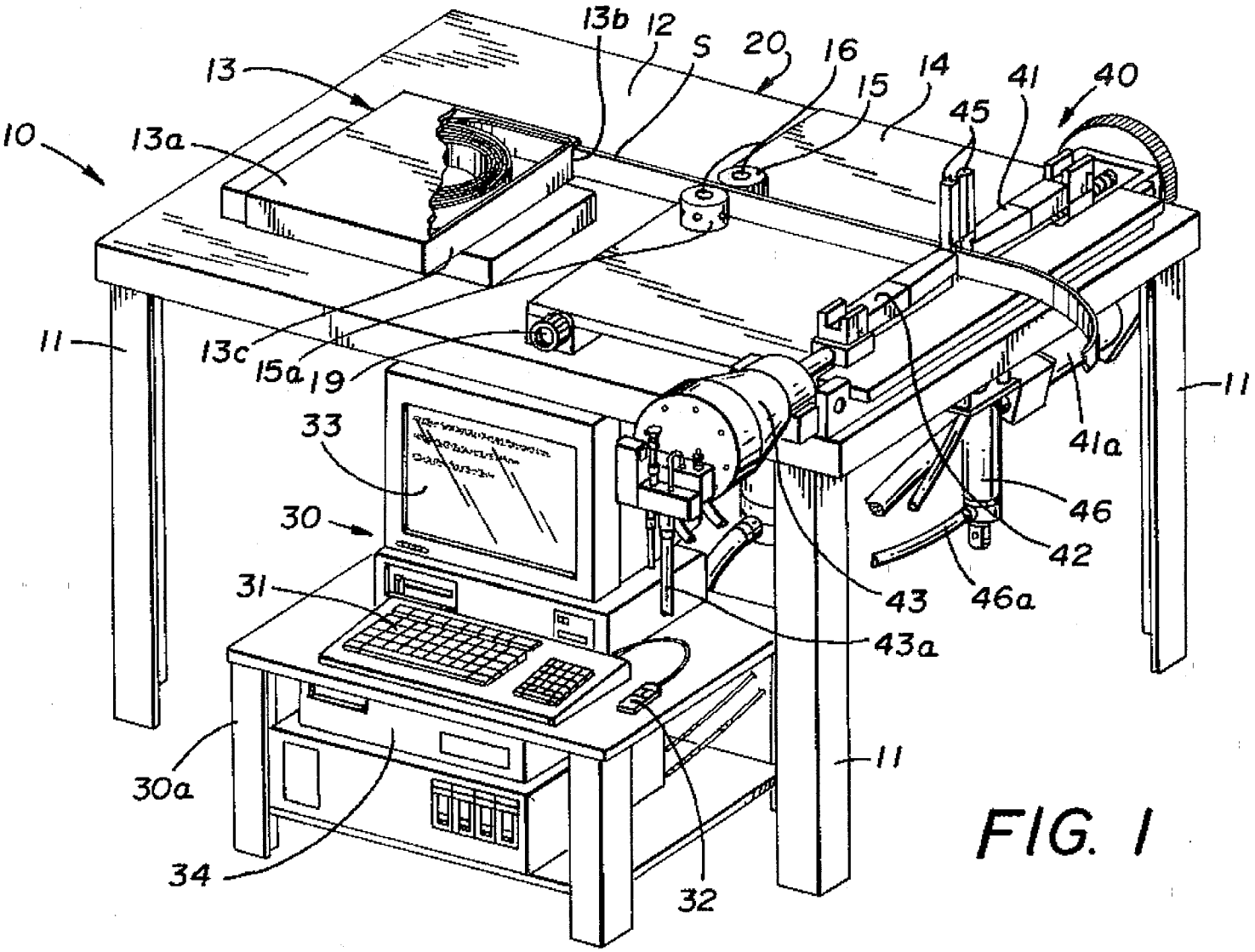
FIG. 1 is a perspective view of the improved automatic rule bender.

Referring first to FIG. 1 of the drawings, it will be seen that the improved rule bender, generally indicated by the numeral 10, includes a support table 20, a controller 30 and a rule bender assembly 40.

The table 10 can take any desired configuration. In the embodiment shown in the drawings, the table includes a plurality of support legs 11,11, a generally rectangular top 12 and a supply source 13 for the stock S. Suitable bracing may be provided if desired.

It will be noted that the stock S is normally provided in coil form in a box 13*a* as shown in FIG. 1 of the drawings with one end of the coil protruding through an opening 13*b* in edge surface 13*c* of the box and eventually into the rule bender assembly 40. This packaging and dispensing arrangement is conventional in the art and will not be described in further detail here.

Figure 2:
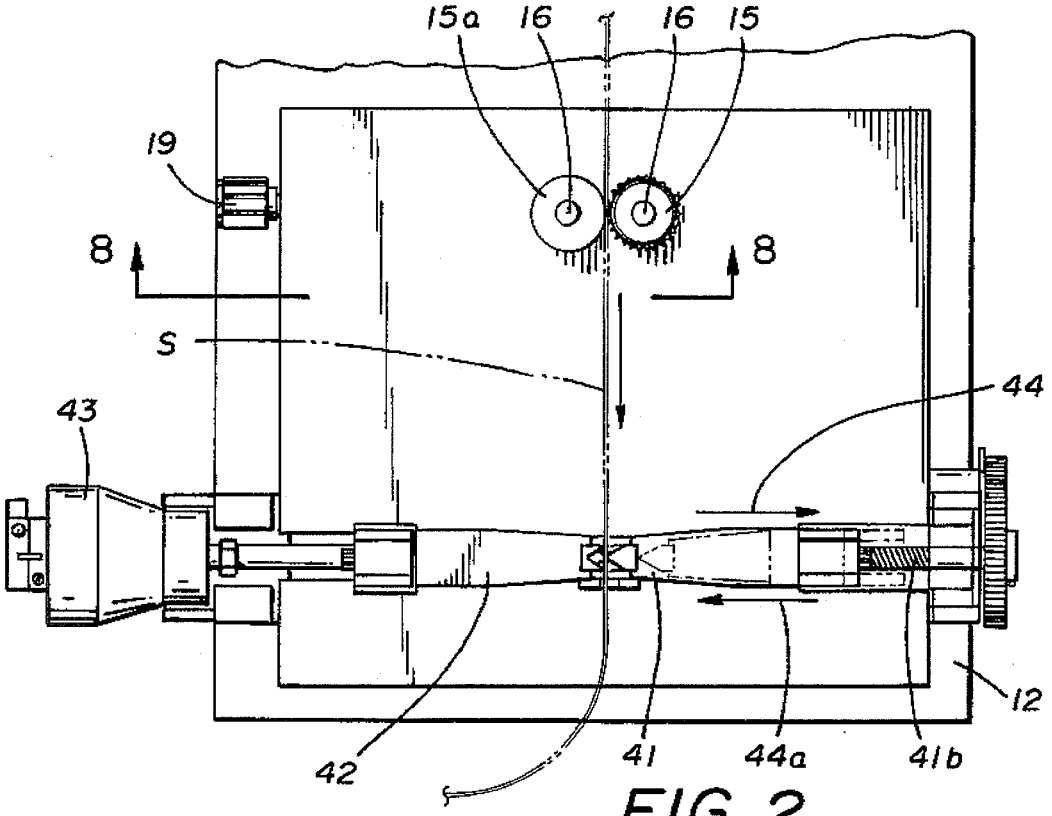
FIG. 2 is a partial top plan view of the improved rule bender of FIG. 1.
Figure 3:
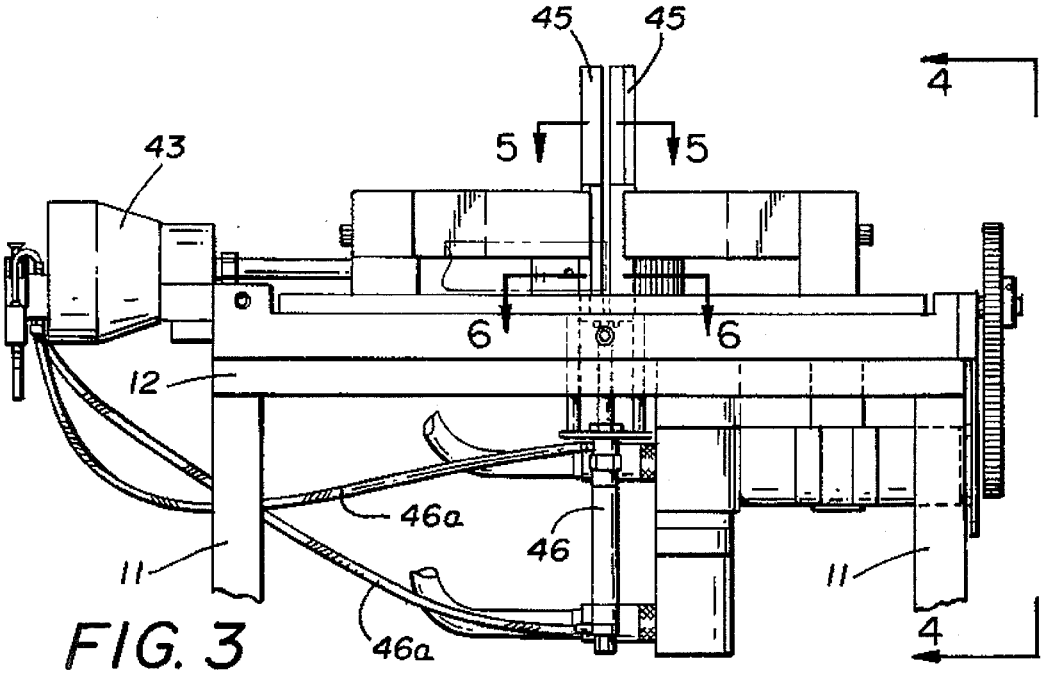
FIG. 3 is a partial elevational view of the improved rule bender.
Figure 4:
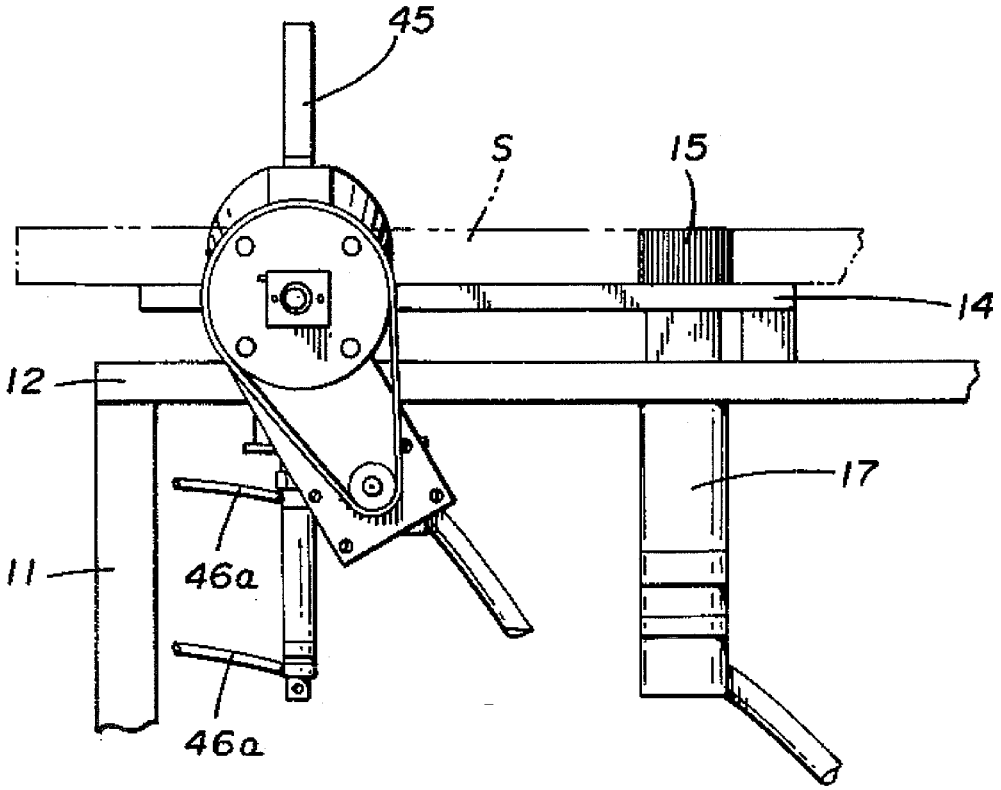
FIG. 4 is an end elevational view taken along the line 4—4 of FIG. 3.
Figure 8:
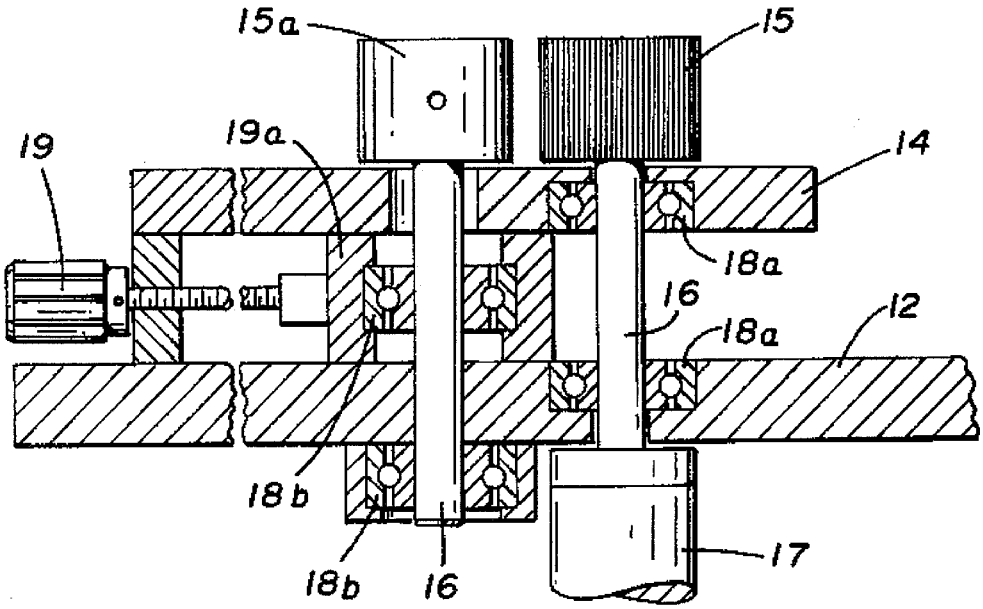
FIG. 8 is a partial sectional view taken along the line 8—8 of FIG. 2.

In the embodiment of the invention illustrated, a supplemental support plate 14 is mounted on the top surface of the top 12 of the support table 10 and carries opposed capstan drive members 15 and 15*a* rotationally mounted on pins. As can be seen in FIGS. 2 and 8, it will be noted that the periphery of the one capstan drive member 15 is serrated or knurled so as to provide a gripping surface to grasp the stock S and pull it from the storage box 13 and move it into the bending apparatus 40. Capstan drive member 15 is driven directly off of motor 17, as will be described, so as to insure a very accurate feed of stock S into the bender 40.

Turning then to the controller 30 carried by table 30*a*, it will be noted that this essentially comprises a PC including the usual keyboard 31, mouse 32, display 33 and drive 34 and which can receive a program and, in this instance, essentially the same program as that utilized in the laser cutter (not shown) except that additional commands are required during the actual bending operation as will become apparent below. It will be appreciated that the PC illustrated is by way of example only and any suitable PC may be used. It will also be noted that controller 30 is shown mounted on a separate table 30*a*, but it will be understood that table 10 could also be modified to receive it.

The bender itself, generally indicated by the numeral 40, is mounted on table 10 and includes opposed operating arms 41 and 42 which are movable toward and away from each other by means of the air head 43 in response to commands from the control apparatus 30. Air head 43 is connected, through line 43*a*, to a suitable source of air (not shown) and is controlled by controller 30 through control 41*a*.

During the actual bending operation, the arm 41, while capable of movement for initial set up purposes, will remain essentially stationery while the arm 42 will reciprocate in the direction of the arrows 44 and 44*a* as shown in FIG. 2.

For setup purposes, however, the arm 41 is positioned in accordance with a predetermined command received from the control system 30 to motor 41*a* which operates through a screw drive 41*b* so as to establish, for setup purposes, the position of the arm 41. That is, upon start up the arm 41 moves to a "home" position in the direction of arrow 44 and then, upon activation of a suitable switch (not shown), moves in the direction of arrow 44*a* to the first position commanded by controller 30 where it remains until a different position command is received.

Figure 5:
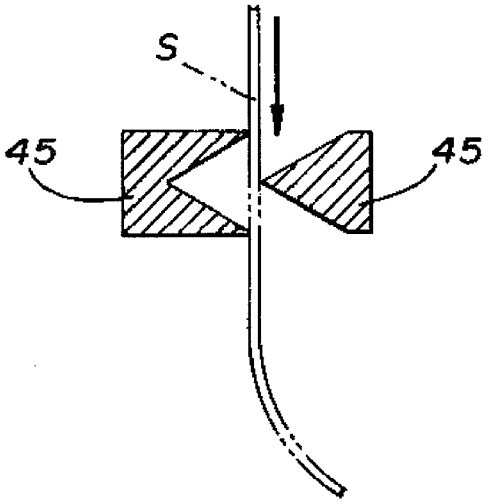
FIG. 5 is a partial sectional view taken along the line 5—5 of FIG. 3.
Figure 6:
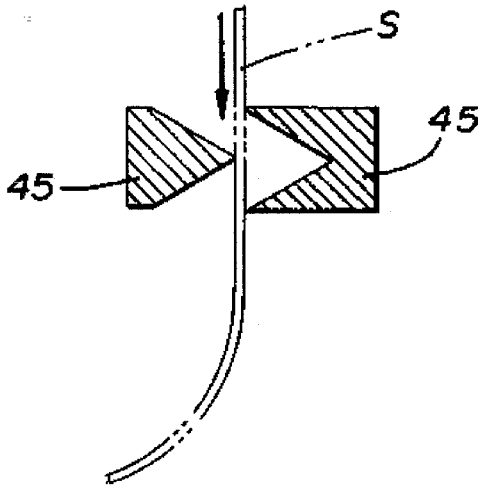
FIG. 6 is a partial sectional view taken along the line 6—6 of FIG. 3.

Arm 42 is reciprocated by the air head 43 through a screw drive toward and away from arm 41, as previously noted, and it will be noted that each arm 41,42 carries die tooling 45. As can be clearly seen in FIG. 1 and FIGS. 5 and 6 of the drawings, the tooling 45 has a complemental male-female orientation which can readily be reversed, if desired. As illustrated in FIG. 1 of the drawings, the tooling shows the female member to the left and associated with arm 42 and the male member 45 to the right and associated with arm 41. As is common, these dies can be easily replaced if worn or if different die configurations are desired.

Figure 7:
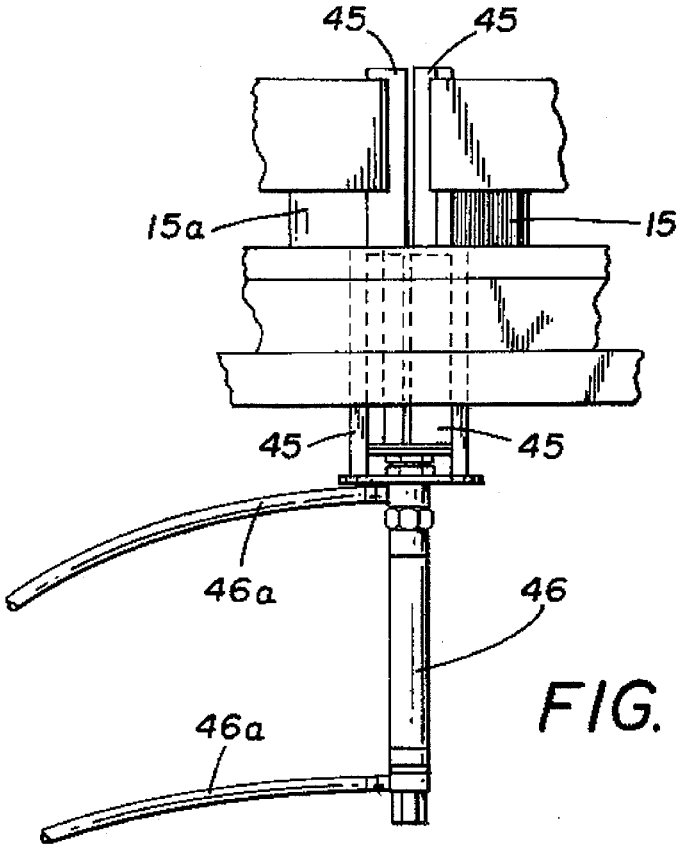
FIG. 7 is an enlarged elevational view showing the rule bender tooling in retracted position.

The tooling 45 is also movable in a vertical direction by means of the air head 46, as can be seen in FIG. 7 of the drawings. This air head is also connected through lines 46*a*,46*a* to a source of air (not shown) and is controlled by controller 30. It will be seen that, in FIG. 1 of the drawings, the tooling 45 is shown in the elevated position to which it would extended for purposes of changing tooling. In FIG. 7, the tooling is shown in retracted position with the air cylinder 46 again operating in response to commands from the controller 30, as required.

The capstan drive is also adjustable. As shown in FIG. 8, the shaft 16 of drive member 15 which is a driven roll is mounted in bearings 18*a*, 18*a* and is thus fixed against lateral movement although free to rotate in response to motor 17. Drive member 15*a* which is actually an idler roll is also mounted in bearings 18*b*, 18*b* but is movable relatively of plate 14 about the axis of its supporting shaft 16 in response to movement of adjustment screw 19 against pivot block 19*a* to adjust the spacing between drive members 15 and 15*a* and the angle at which the axes of the support shaft 16 is disposed to thus control the stock. In that regard, such adjustment makes it possible to accommodate various thicknesses of the stock and also permits the rolls to be effectively canted toward each other to prevent the stock from working up and out of the bite between the rolls during operation.

It should also be noted here that the serrations or knurling on drive member 15 serves several purposes. Thus, in addition to improving the grip on the stock it assists in keeping the material from "walking" up out of the bite between drive members 15 and 15*a*. Also, the teeth actually make slight tracks or impressions in the material. In addition to providing better traction, and thus more precision in the feeding operation, when the drive members are reversed, as may be required in certain bending operations, the teeth actually mesh with the tracks previously formed to enhance reliability.

In use or operation of the improved rule bender, it will first be assumed that a suitable program will be fed into the PC which is part of the controller 30. This will be essentially the same program utilized for the laser cutter (not shown) with some additional commands added to it.

The controller 30 is then actuated in response to a command dictated by the particular size or gauge of stock being employed. This will actuate the control 41*a* which will in turn set arm 41 to the proper starting position. It will also be assumed at this point that suitable tooling 45,45 will have been inserted into the bender 40. The tooling will then be in the vertically and horizontally retracted position of FIG. 7 and prepared to receive the stock S from the supply box 13. This stock S is then threaded through the capstan drives 15,15*a* to a position between the tooling 45,45.

In response to commands from the controller 30, the motor 17 will rotate the capstan drive to feed a suitable length of stock into the tooling 45,45 and the air head 43 will be activated and, once between the tooling, will relax the clamping force either by cutting off the motor 17 or reducing current. This permits the stock to move in response to the bending force from arm 42. This air head will drive the arm 42 and its associated tool toward the arm 41 and its associated tool. Initially, the bender is closed with light pressure. The capstan drive then releases or frees the material S so that the bender 40 may then finish the bend under higher pressure without fighting the capstan drive or causing distortion of the desired bend as mentioned.

As predetermined, the arm 42 will advance and retract a predetermined number of times and a constant distance depending upon the angle or degree of the bend intended to be imparted to the stock S. When that angle has been achieved, the controller 30 will open bender 40 and the capstan drive, in response to commands from the controller 30, will again advance sufficient stock to the next bend and the operation will be repeated until a sufficient number of operations have been performed on the stock S to impart the desired geometric configuration to the finished part. At that time, a tooling change will be made so that the upper set of tooling 45,45 will have the male and female tools oriented in one direction and the lower set oriented in the opposed direction as shown in FIG. 7. Then, repetitive identical strokes of the arm 42 while alteratively raising and lowering the tooling by the air head 46, without advance of the stock, will eventually flex the material to cause cut off and severance of the piece which can then be removed and fitted into the kerf of the die board.

Thus, it will be seen that an improved automatic rule bender has been produced which provides a rule formed precisely in conformity with the program for the kerf and which provides a very accurate feed for the material which makes it possible to perform complex forming operations very economically.

While a full and complete description of the invention has been set forth in accordance with the dictates of the patent statutes, it should be understood that modifications can be resorted to without departing from the spirit hereof or the scope of the appended claims.

What is claimed is:

1. An automatic rule die bender for automatically bending rule die stock into various shapes for assembly on a laser cut board, comprising:

a) drive means for feeding the stock to the bender;

b) bending means including opposed removable tools and at least one of said tools being movable toward and away from the stock;

c) control means for controlling said drive means to selectively move the stock toward the bender and release tension on the stock and controlling the movement of said bending means; and d) said bending means adapted to sever the stock upon completion of the bending operation.

2. The automatic die rule bender of claim 1 wherein said drive means include a driven member and an idle member; and adjustment means are provided for moving said idle member toward or away from said driven member altering the spacing between said driven member and said idle member.

3. The automatic die rule bender of claim 2 wherein said driven member and said idle member are mounted on shafts; and said adjustment means are operative to alter the angle between the longitudinal axes of said shafts.

4. The automatic die rule bender of claim 2 wherein at least one of said driven member and said idle member has a knurled periphery for engagement with the stock.

5. The automatic die rule bender of claim 1 wherein said bending means include opposed first and second elongate operating arms; and bending tooling means releasably associated with adjacent ends of said first and second operating arms.

6. The automatic die rule bender of claim 1 wherein said first operating arm is reciprocal toward and away from said second operating arm; and said second operating arm is axially adjustable between fixed positions with respect to said first operating arm.

7. The automatic die rule bender of claim 6 wherein an air head is connected to said first operating arm and said control means.

8. The automatic die rule bender of claim 5 wherein said bending tooling means includes a fixture adapted to receive two sets of tooling and is selectively movable normally with respect to the direction of movement of said first operating arm.

9. The automatic die rule bender of any one of claims 1 to 8 wherein said control means include a PC programmed complementally with the program utilized to laser cut the board.

10. A method of automatically bending rule die stock into a predetermined configuration for assembly on a laser cut board comprising the steps of:

a) providing a system controller with a program for the predetermined configuration;

b) feeding the stock as required in response to signals from the controller;

c) setting the bending means in response to signals from the controller;

d) operating the bending means and the feeding of the stock in response to signals from the controller; and e) selectively releasing feeding tension during operation of the bending means.

11. An automatic rule die bender for automatically bending rule die stock into various shapes for assembly on a laser cut board, comprising:

a) drive means for feeding the stock to the bender;

b) bending means including removable tools and being movable toward and away from the stock;

c) control means for controlling said drive means and the movement of said bending means;

d) said bending means including opposed first and second operating arms;

e) bending tooling means releasably associated with adjacent ends of said first and second operating arms; and f) said bending tooling means includes a fixture adapted to receive two sets of tooling and is selectively movable normally with respect to the direction of movement of said first operating arm.

12. The automatic die rule bender of claim 11 wherein said control means include a PC programmed complementally with the program utilized to laser cut the board.

13. The method of claim 10 wherein said bending means sever the stock upon completion of the bending operation.

14. The method of claim 10 wherein the bending means include opposed bending tooling and the spacing between said tooling is adjusted prior to the bending operation in response to signals from the controller.

15. The method of claim 10 wherein the bending means include opposed bending tooling and the spacing between said tooling is adjusted prior to the bending operation in response to signals from the controller; one of the bending tooling being fixed and the other reciprocating relatively thereof during the bending operation.

* * * * *